US008554119B2

(12) United States Patent
Terai

(10) Patent No.: US 8,554,119 B2
(45) Date of Patent: Oct. 8, 2013

(54) DEVELOPING DEVICE, IMAGE FORMING APPARATUS, AND PROCESS CARTRIDGE

(75) Inventor: Junichi Terai, Kanagawa-ken (JP)

(73) Assignee: Ricoh Company, Ltd., Tokyo (JP)

( * ) Notice: Subject to any disclaimer, the term of this patent is extended or adjusted under 35 U.S.C. 154(b) by 317 days.

(21) Appl. No.: 12/953,869

(22) Filed: Nov. 24, 2010

(65) Prior Publication Data

US 2011/0123234 A1 May 26, 2011

(30) Foreign Application Priority Data

Nov. 25, 2009 (JP) ..... 2009-267603

(51) Int. Cl.
*G03G 15/09* (2006.01)

(52) U.S. Cl.
USPC ..... 399/273; 399/272; 399/274

(58) Field of Classification Search
USPC ..... 399/272–277
See application file for complete search history.

(56) References Cited

U.S. PATENT DOCUMENTS

| | | | | |
|---|---|---|---|---|
| 4,714,046 | A | 12/1987 | Steele et al. | |
| 5,987,288 | A * | 11/1999 | Mori et al. | 399/269 |
| 6,337,957 | B1 | 1/2002 | Tamaki et al. | |
| 6,522,855 | B1 | 2/2003 | Katoh et al. | |
| 6,681,092 | B2 | 1/2004 | Terai | |
| 6,757,510 | B2 | 6/2004 | Terai | |
| 6,985,165 | B2 | 1/2006 | Terai | |
| 7,289,755 | B2 | 10/2007 | Terai | |
| 2008/0279592 | A1 | 11/2008 | Matsumoto et al. | |
| 2008/0317508 | A1 | 12/2008 | Terai et al. | |
| 2009/0067877 | A1 | 3/2009 | Terai | |
| 2009/0067890 | A1 * | 3/2009 | Maeyama et al. | 399/273 |

FOREIGN PATENT DOCUMENTS

| | | |
|---|---|---|
| JP | 57-190974 | 11/1982 |
| JP | 60-39053 | 3/1985 |
| JP | 4-65379 | 10/1992 |
| JP | 5-158353 | 6/1993 |
| JP | 11-258909 | 9/1999 |
| JP | 3127594 | 11/2000 |
| JP | 3610547 | 10/2004 |
| JP | 2007-101797 | 4/2007 |
| JP | 2009-136052 A | 6/2009 |

* cited by examiner

*Primary Examiner* — Hoang Ngo
(74) *Attorney, Agent, or Firm* — Oblon, Spivak, McClelland, Maier & Neustadt, L.L.P.

(57) ABSTRACT

A developing system includes a first developer carrier to carry and supply two-component developer including toner and carrier to a latent image formed on an image bearer. A first magnetic field generator having plural first magnetic poles is rotatably installed in the first developer carrier and causes the two-component developer to put forth ears and conveys the two-component developer on the developer carrier. A cross-sectional center of the first magnetic field generator is deviated from that of the first developer carrier toward the image bearer by a prescribed length. A developer peel-off device including a second magnetic field generator is provided in the vicinity of the surface of the first developer carrier to peel off the developer not supplied to the image bearer and remaining on the surface of the first developer carrier.

9 Claims, 6 Drawing Sheets

FIG. 6A

| | CONVENTIONAL EXAMPLE | FIRST PRACTICAL EXAMPLE | SECOND PRACTICAL EXAMPLE | THIRD PRACTICAL EXAMPLE |
|---|---|---|---|---|
| NUMBER OF MAGNETIC POLES (POLES) | 5 | 10 | 10 | 10 |
| NUMBER OF ROTATIONS OF DEVELOPING SLEEVE (RPM) | 400 | 300 | 180 | FIXED |
| NUMBER OF ROTATIONS OF MAGNETIC ROLLER (RPM) | FIXED | 600 | 1200 | 2000 |
| NUMBER OF PASSAGE TIMES OF MAGNETIC POLE (TIMES) | 5 | ABOUT 15 | ABOUT 30 | ABOUT 50 |

FIG. 6B

| | FOURTH PRACTICAL EXAMPLE | FIFTH PRACTICAL EXAMPLE |
|---|---|---|
| NUMBER OF MAGNETIC POLES | 10 | 10 |
| NUMBER OF ROTATIONS OF SLEEVE (RPM) | 400 | 100 |
| NUMBER OF ROTATIONS OF MAGNETIC ROLLER (RPM) | 400 | 1200 |
| NUMBER OF PASSAGE TIMES OF MAGNETIC POLE (TIMES) | ABOUT 10 | ABOUT 40 |
| ROTATIONAL DIRECTIONS OF SLEEVE AND MAGNETIC ROLLER | OPPOSITE | SAME |

DEVELOPING DEVICE, IMAGE FORMING APPARATUS, AND PROCESS CARTRIDGE

CROSS-REFERENCE TO THE RELATED APPLICATIONS

This application claims priority pursuant to 35 USC §119 to Japanese Patent Application No. 2009-267603, filed on Nov. 25, 2009, the entire contents of which are hereby incorporated by reference herein.

BACKGROUND OF THE INVENTION

1. Field of the Invention

The present invention relates to a developing device, an image forming apparatus, and a process cartridge, and in particular to a developing mechanism, which employs two-component developer having toner and carrier.

2. Description of the Background Art

In an image forming apparatus, such as a copier, a printer, a facsimile machine, a duplicator, etc., a latent image is formed on a photoconductive member and is visualized by a developing device. The visualized image is then transferred onto a sheet or the like as a printing output.

One- or two-component developer including only magnetic or non-magnetic toner or a mixture of such toner and carrier can be used.

The toner in the two-component developer is charged triboelectrically by frictional electrification when stirred and mixed, to be attracted to a latent image formed on a photoconductive member.

The developing device includes a developing sleeve that carries and supplies developer to a latent image on a photoconductive member. The developing sleeve causes the developer particles to form upright ears on its circumferential surface. The developing device also includes a stirring member, such as a screw auger, etc., that stirs, mixes, and supplies the developer to the developing sleeve. The developer on the developing sleeve is flattened by a doctor blade or the like to form a layer having a prescribed thickness and amount, and is supplied to a latent image on the photoconductive member.

As described in Japanese Patent Application Laid Open No. H11-258909 (JP-H11-258909-A), it is known that developing quality generally varies depending on an amount of developer used in developing and/or remaining amount of the developer downstream of a developing region.

Accordingly, it has been attempted in the past that a developing history is erased by peeling off the remaining developer downstream of the developing region while supplying fresh developer as described in JP-H11-258909-A. Specifically, a developing roller having a magnetic recording layer on its circumferential surface is provided to convey developer to a region of the circumferential surface facing an image bearer.

Further provided is a peeling-off roller downstream from the developing region. The peel-off roller includes a non-magnetic sleeve and plural rotatable magnets installed therein. The peeling-off roller closely approaches the circumferential surface of the developing roller to peel off multiple layers of the developer formed thereon.

The above-mentioned peeling off operation is achieved by the mechanism described below.

When the same images are successively developed in previous developing cycles, developer carried on the developing roller remains unpeeled. Thus, when the next developing cycle is executed while carrying fresh developer, a developing pattern formed in the previous developing cycle appears as a history.

As a result, toner density, charge amount, and particle diameter or the like (corresponding to the developing pattern) become different in a region with the developing history from those in another region without the same unless the history is erased. Specifically, the developing pattern causes a ghost on the next image (especially, a halftone image) during the next developing cycle, that is otherwise generally absent in an image formation area, thereby likely exacerbating image reproducibility and quality.

Then, to erase the developing history with the structure as described in the JP-H11-258909-A, the developer must be peeled off from the developer carrier.

However, since the above-mentioned peel-off roller is constructed of the non-magnetic sleeve and the plural rotatable magnets installed in the vicinity of the non-magnetic sleeve as described above, magnetic interference increasingly likely occurs between the developing roller side magnet and the peel-off roller side magnet as these magnets rotate.

Further, when vibration occurs between prescribed members due to the magnetic interference or the developer remains on the developing roller, an abnormal image having one or more stripes are likely created.

SUMMARY OF THE PRESENT INVENTION

Accordingly, an object of the present invention is to provide a new and novel developing the includes a first developer carrier to carry and supply two-component developer including toner and carrier to a latent image formed on an image bearer. A first magnetic field generator having plural first magnetic poles is rotatably installed in the first developer carrier and causes the two-component developer to put forth ears and conveys the two-component developer on the developer carrier. A cross-sectional center of the first magnetic field generator is deviated from that of the first developer carrier toward the image bearer by a prescribed length. A developer peel-off device including a second magnetic field generator is provided in the vicinity of the surface of the first developer carrier to peel off the developer not supplied to the image bearer and remaining on the surface of the first developer carrier.

In another aspect, the second magnetic field generator includes a second magnetic filed creating member having plural second magnetic poles secured to the developing system, and a rotatable developer conveyance member arranged overlying the plural second magnetic poles.

In yet another aspect, the plural two second magnetic poles have a prescribed arrangement capable of creating a repulsive magnetic field removing the developer attracted to the rotatable developer conveyance member of the second magnetic field generator therefrom.

In yet another aspect, one of the plural second magnetic poles faces one of the plural first magnetic poles arranged farthest among the plural first magnetic poles from an inner circumferential surface of the first developer carrier (owing to the eccentricity of the first magnetic field generator toward the developer carrier).

In yet another aspect, a bias controller is provided to apply a prescribed bias between the first developer carrier and the developer peel-off device. The prescribed bias causes the toner to move from the first developer carrier to the developer peel-off device.

In yet another aspect, the bias controller creates a prescribed voltage difference capable of moving the toner from the first developer carrier to the developer peel-off device.

In another aspect, the rotatable developer conveyance section moves in an opposite direction to the developer carrier at a gap therebetween.

In yet another aspect, an image forming apparatus includes the developing system.

In yet another aspect, a process cartridge includes an image bearer to bear an image, the developing system to develop the image, and a holder to hold the developing system and the image bearer in a block.

BRIEF DESCRIPTION OF DRAWINGS

A more complete appreciation of the present invention and many of the attendant advantages thereof will be readily obtained as the same becomes better understood by reference to the following detailed description when considered in connection with the accompanying drawings, wherein:

FIGS. 6A and 6B collectively illustrate exemplary conditions and results of experiments for obtaining number of times when the magnetic poles included in a developing sleeve of the developing device of FIG. 3 passed developer carried on a developing sleeve.

DESCRIPTION OF THE PREFERRED EMBODIMENTS

Figure 1:
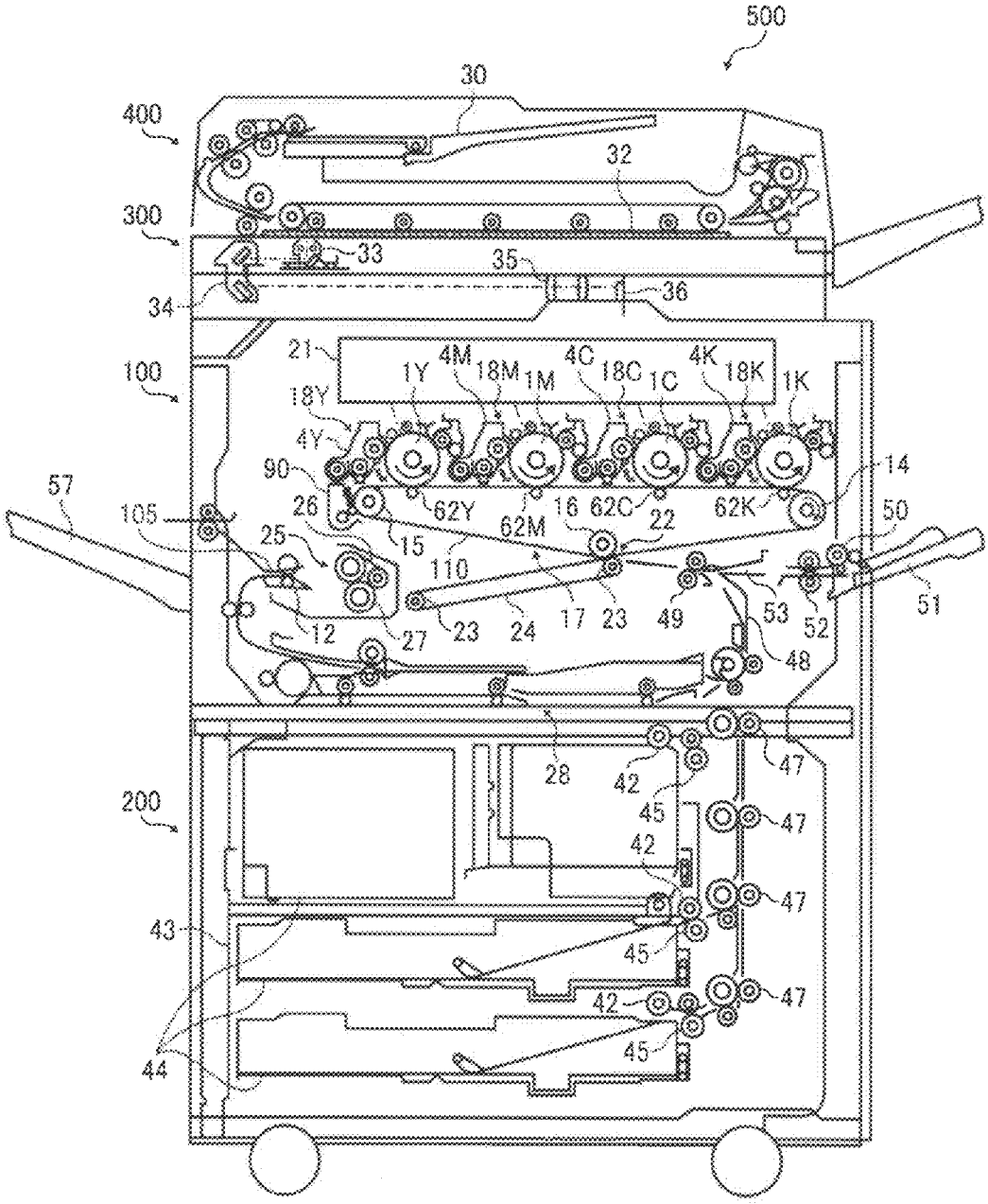
FIG. 1 illustrates an exemplary image forming apparatus that employs plural process cartridges each including a developing device according to one embodiment of the present invention.

Referring now to the drawings, wherein like reference numerals designate identical or corresponding parts throughout several views, in particular in FIG. 1, an image forming apparatus to employ a developing device of the present invention is a tandem type full-color printer (hereinafter referred to as a copier 500), for example. However, the present invention can be applied to a copier or a facsimile machine or the like.

The copier 500 includes a printing section 100, a sheet feeding device 200 mounted by the printing section 100, and a scanner 300 secured to the printing section 100 or the like.

An original document automatic original document-feeding device (herein after referred to as an ADF) 400 is secured onto the scanner 300.

The printing section 100 includes an image formation unit having four units of process cartridges 18Y-K for forming yellow, magenta, cyan, and black images, respectively.

Letters Y to K added to reference numbers represent yellow to black members, respectively, hereinafter. Beside the process cartridges 18Y-K, there are provide an optical writing unit 21, an intermediate transfer unit 17, a secondary transfer device 22, a pair of registration rollers 49, a belt type fixing device 25 or the like.

The optical writing unit 21 includes a light source, a polygonal mirror, a F-θ lens, a reflection mirror or the like and emits a laser light onto a surface of a photoconductive member in accordance with image data as mentioned later in detail.

Each of the process cartridges 18Y-K includes a drum photoconductive member 1, a charge device, a developing device 4, a drum cleaning device, and a charge removing member or the like.

Now, a process cartridge 18 for yellow is typically described. The surface of the photoconductive member 1Y is uniformly charged by the charge device and is subjected to an emission of the laser light modulated and diffused by the optical writing unit 21. Thus, a potential of the surface subjected to the light emission of the photoconductive member 1Y is attenuated. As a result, a latent image is formed on the photoconductive member 1Y and is developed to be a Y toner image by the developing device 4Y.

The Y toner image on the photoconductive member 1Y is then transferred onto the intermediate transfer belt 110 mentioned later in detail. Toner remaining on the surface of the photoconductive member 1Y is removed by a drum-cleaning device after a primary transfer process is completed.

In the process cartridge 18Y, the photoconductive member 1Y having been subjected to the drum cleaning is then subjected to charge removal of the charge removing device. Then, the charge device uniformly charges and bring the photoconductive member 1Y to an initial condition. The same sequential process as above is executed in the remaining process cartridges 18M-K.

Now, the intermediate transfer unit 17 is more specifically described. The intermediate transfer unit 17 includes an intermediate transfer belt 110 and a belt cleaning device 90 or the like. Further included are a stretching roller 14, a driving roller 15, a secondary transfer backup roller 16, and four primary transfer bias rollers 62Y-K or the like.

Thus, the intermediate transfer belt 110 is stretched by the plural rollers including the stretching roller 14 and endlessly travels clockwise as a driving roller 15 is driven by a driving motor, not shown.

Four primary bias rollers 62Y-K are arranged contacting the inner circumferential surface of the intermediate transfer belt 110 while receiving a primary transfer bias from a power supply, not shown. These primary bias rollers 62Y-K also depress the intermediate transfer belt 110 from inner circumferential surface side against the photoconductive members 1Y-K, thereby forming primary transfer nips, respectively. A primary transfer electric field is created between the photoconductive member 1 and the primary transfer bias roller 62 by the primary transfer bias in each of the respective primary transfer nips.

Thus, the above-mentioned Y toner image on the photoconductive member 1Y is transferred onto the intermediate transfer belt 110 by impact of the primary transfer electric field and a nip pressure. Respective toner images of M-K on the photoconductive members 1M-K are sequentially transferred onto Y toner image one by one during the primary transfer process. As a result, a four-component color superimposed toner image is formed on the intermediate transfer belt 110.

The four-component color superimposed toner image is then transferred onto a recording medium of a transfer sheet, not shown, at a secondary transfer nip as mentioned later in detail during a secondary transfer process. The toner remaining on the surface of the intermediate transfer belt 110 after passing through the secondary transfer nip is removed by the belt-cleaning device 90 that sandwiches the intermediate belt with the driving roller 15 arranged on the left side thereof in the drawing.

Now, a secondary transfer device 22 is described more in detail. There is provided, below the intermediate transfer unit 17, the secondary transfer device 22 having a pair of stretching rollers 23 that stretches a sheet conveyance belt 24. The sheet conveyance belt 24 is endlessly rotated counter clockwise in the drawing as at least one of the stretch rollers 23 rotates. One of the two stretch rollers 23 arranged on the right side in the drawing sandwiches the intermediate transfer belt 110 and the sheet conveyance belt 24 with the secondary transfer backup roller 16 of the intermediate transfer unit 17. Owing to the sandwiching, a secondary transfer nip is formed where the intermediate transfer belt 110 of the intermediate transfer unit 17 contacts the sheet conveyance belt 24 of the secondary transfer device 22. Further, a power supply, not shown, applies a secondary transfer bias having an opposite polarity to the toner to one of the stretch roller 23.

Owing to the application of the secondary transfer bias, a secondary transfer electric field is created in the secondary transfer nip to electro-statically move the four component color toner image on the intermediate transfer belt 110 of the intermediate transfer unit 17 from the intermediate belt 110 toward one of the stretch roller 23. With the pair of registration rollers 49 mentioned later, the four component color (superimposed) toner image on the intermediate transfer belt 110 is transferred onto a transfer sheet conveyed to the secondary transfer nip in synchronism with the four component color (superimposed) toner image while receiving impact of the secondary transfer electric field and a nip pressure. Instead of the above-mentioned secondary transfer system, a non-contact type charger for charging a transfer sheet via a gap can be employed.

Plural sheet cassettes 44 are vertically piled up overlapping with each other while accommodating plural transfer sheets in a bundle state. A sheet-feeding roller 42 contacts the top-most transfer sheet on the sheet bundle in each of the sheet feeding cassettes 44. By rotating the sheet-feeding roller 42, the top most transfer sheet is fed toward a sheet-feeding path 46.

On the sheet feeding path 46 that receiving the above-mentioned transfer sheets from the sheet-feeding cassette 44, there are provided plural pair of conveyance rollers 47 and a pair of registration rollers 49 arranged in the vicinity of the end of the sheet-feeding path 46. Then, the transfer sheet is conveyed toward the pair of registration rollers 49 and is pinched there between. The four-component color (superimposed) toner image on the intermediate transfer belt 110 of the intermediate transfer unit 17 enters the secondary transfer nip as the intermediate belt 110 endlessly travels. Such a pair of registration rollers 49 launches the transfer sheet pinched therebetween at a prescribed time so that the transfer sheet can tightly contact the four-component color (superimposed) toner image in the secondary transfer nip.

Owing to this, in the secondary transfer nip, the transfer sheet of a white color is subjected to the secondary transfer process to have a full-color image. The transfer sheet with the full color image in this way is conveyed to a fixing device 25 from the second transfer nip as the sheet conveyance belt 24 endlessly travels.

The fixing device 25 includes a belt unit having two rollers stretching and endlessly rotating a fixing belt 26, and a pressing roller 27 that presses the belt against one of these two rollers of the belt unit. The fixing belt 26 and the pressing roller 27 contact each other and creates a fixing nip there between to collectively pinch the transfer sheet upon receiving it from the sheet transfer belt 24. One of the two rollers of the belt unit pressed by the pressing roller 27 includes a heat source, not shown, to heat the fixing belt 26 when heat source operates. The heated fixing belt 26 heats the transfer sheet pinched in the fixing nip. Owing to impact of the heat and a nip pressure, the full-color image is fixed onto the transfer sheet.

The transfer sheet having been subjected to the fixing process in the fixing device 25 is either stacked on a stack section 57 arranged outside an left side plate of a printer casing or is returned to the above-mentioned secondary transfer nip to form a toner image on another side thereof.

When an original document, not shown, is copied, a bundle of sheet original documents, for example, is placed and set onto an original document table 30. When the original document is a book type with it one side bound, it is set onto a platen glass 32. Prior to the setting thereof, the automatic document feeder 400 is open in relation to the copier, and the platen glass 32 of the scanner 300 is exposed. Then, the one side bound original document is pressed by the automatic document feeder 400 when the ADF 400 is closed.

Then, after the original document is set, a copy start switch, not shown, is depressed, whereby the scanner 300 starts reading the original document. When the original document of a sheet is set onto the platen glass 32, prior to the reading thereof, the automatic document feeder 400 automatically conveys the original document to the platen glass 32. As an original document reading operation, both of first and second carriages 33 and 34 start running, while a light source provided on the first carriage emits a light. The light reflected from the surface of the original document is then reflected by a mirror arranged on the second carriage 34, and enters a reading sensor 36 via an imaging lens 35. Such a reading sensor 36 generates image information based on such an incident radiation.

In parallel to the above-mentioned original document reading, devices arranged in each of the respective process cartridges 18Y-K, the intermediate transfer unit 17, the secondary transfer device 22, and the fixing device 25 start operating. Then, the optical writing unit 21 is also driven and controlled to form toner images of respective colors Y-K on the photoconductive members 1Y-K, respectively, in accordance with the image information generated by the reading sensor 36. These toner images are superimposed on the intermediate transfer belt 110 to be a four-component color (superimposed) toner image.

Further, at almost the same time as the original document reading, a sheet feeding operation starts in the sheet-feeding device 200. Specifically, one of the sheet feeding rollers 42 is selectively rotated and launches a transfer sheet from one of the sheet feeding cassettes 44 arranged in the multiple steps in a paper bank 43. The launched transfer sheets are separated by a separation roller 45 one by one and enters a reversing sheet feeding path 46. The transfer sheet is then conveyed to the secondary transfer nip by a pair of conveyance rollers 47. Instead of such sheet feeding from the sheet-feeding cassette 44, it is manually fed sometimes from a manual sheet-feeding tray 51. In such a situation, a manual sheet-feeding roller 50 is selectively rotated and launches a transfer sheet on the manual sheet-feeding tray 50 and launches the transfer sheet thereon. The transfer sheets launched from the manual sheet feeding tray 51 are separated and further conveyed to a manual sheet feeding path 53 provided in the printing section 100 by a pair of separation rollers 52 one by one.

The intermediate transfer belt 110 of the copier 500 is stretched with its upper stretch plane extending almost horizontal while contacting all of the photoconductive members 1Y-K when a multi color image including more than two colors is formed. Whereas when a monochrome image of only K-color is formed, the intermediate transfer belt 110 of the copier 500 is inclined left side down in the drawing with its upper stretch plane being separated from the photoconductive members 1Y-C. Then, only the photoconductive member 1K is rotated counter clockwise to form only a K-toner image. At this moment, developing devices 4 for the photoconductive members Y-C are also stopped driving to avoid wasteful consumption of members of the photoconductive member 1 and the developing device 4, as well as toner stored in the developing device 4.

The copier 500 also includes a controller section, not shown, having a CPU or the like for generally controlling each of the members of the copier 500, and an operation display section having a liquid crystal display and various key buttons or the like. An operator can select one of the below described three modes of a simplex print mode where an image is formed only on one side surface of a transfer sheet by executing a key input operation through the operation display and transmitting an instruction to the controller section. Such a simplex mode includes a direction ejection mode, a reverse ejection mode, and a reverse de-curl ejection mode.

Now, the developing device 4 and the photoconductive member 1 provided in each of the four-process cartridges 18Y-K are described with reference to FIG. 2.

These four-process cartridges 18Y-K employ almost the same structure and are only different from the other by storing different color toner. Thus, the developing device 4 typically represents all of the developing devices for the respective colors.

Figure 2:
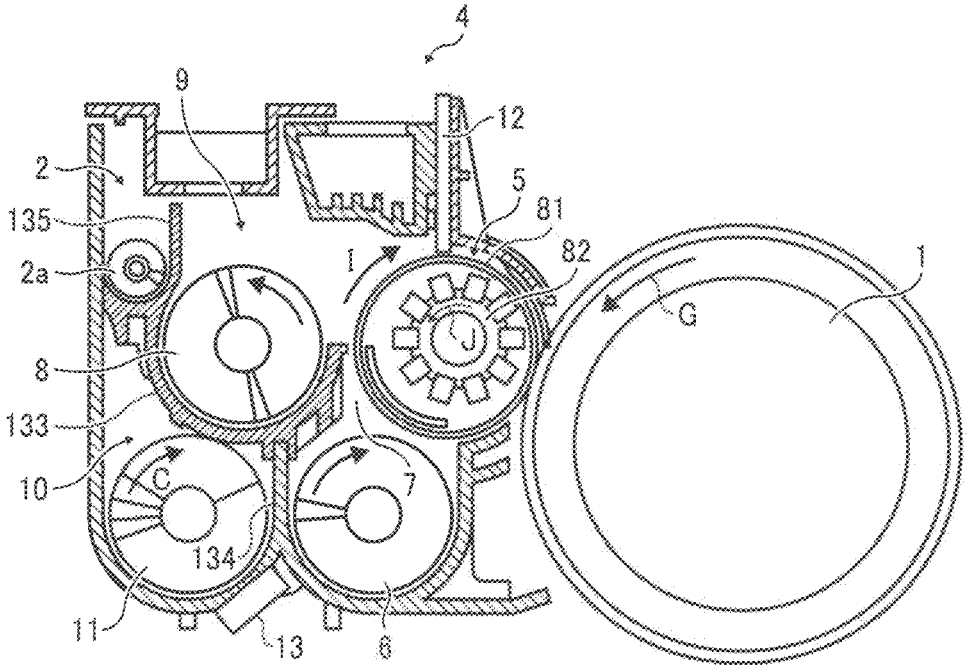
FIG. 2 typically illustrates an exemplary structure and operation of the process cartridge of FIG. 1.

In anyway, as shown in FIG. 2, the surface of the photoconductive member 1 is charged by a charge device, not shown, while rotating in a direction as shown by an arrow G, and is exposed to a laser light emitted from an exposure device, not shown, whereby forming a latent image. The latent image is then developed by the developing device 4 when toner is supplied thereto. The developing device 4 includes a developing roller 5 that supplies toner to a surface of a latent image on a photoconductive member 1 while conveying developer in a direction as shown by an arrow I.

The developing roller 5 includes a rotatable developing sleeve 81. Plural freely rotatable magnetic rollers 82 having plural magnetic poles are installed in the developing sleeve 81 in a direction as shown by an arrow J to generate magnetic force. The developing roller 5 and a peel-off device that peels off carrier and toner remaining thereon after passage of a developing region are mentioned later in detail.

Further, a supply screw 8 is provided to convey developer to a front side in the drawing sheet of FIG. 2 along a shaft line of the developing roller 5 while supplying the same to the developing roller 5.

A doctor blade 12 is provided downstream from a facing section where the developing roller 5 and the supply screw 8 face each other to adjust a thickness of developer supplied to the developing roller 5 to be suitable for development.

A collection conveyance path 7 is also provided to face the developing roller 5 at downstream from the developing region where the developing roller 5 faces the photoconductive member 1 and collect developer of post development separated from the developing roller 5.

The collection conveyance path 7 is defined by a supply screw 8 that conveys collected developer along the shaft direction of the developing roller 5 and a spiral collection screw 6 that is arranged in parallel to the shaft direction. A supply conveyance path 9 with the supply screw 8 is arranged beside the developing roller 5. Thus, the supply conveyance path 7 with the collection screw 6 is arranged below the developing roller 5.

The developing device 4 includes a stirring conveyance path 10 arranged beside the collection conveyance path 7 and below the supply conveyance path 9. A stirring screw 11 is provided beside the stirring conveyance path 10 in parallel to a shaft line direction of the developing roller 5 to convey developer to a rear side in the drawing sheet of FIG. 2 as opposite to the supplying screw 8 along the shaft line thereof while stirring the developer.

These stirring conveyance path 10 and supply conveyance path 9 are separated by a first partition wall 133 that includes plural openings at both front and rear side ends to communicate these paths 10 and 9 with each other.

Further, the collection conveyance path 7 and the supply conveyance path 9 are also separated by the first partition wall 133. However, an opening is not formed on the first partition wall 133 to communicate these paths 7 and 9 with each other.

The stirring conveyance path 10 and the collection conveyance path 7 are also separated by a second partition wall 134 that includes an opening at a front side end in the drawing to communicate these paths 10 and 7 with each other.

The supplying screw 8, the collection screw 6, and the stirring screw 11 are made of resin or metal. A diameter of each of the screws 8, 6, and 11 is the same to be 22 mm. Pitches of the respective screws 8, 6, and 11 are 50, 25, and 25 mm. A number of independent mountains of each of the screws 8, 6, and 11 is 2, 1, and 1, respectively. A number of rotations of each of the screws 8, 6, and 11 is 600 (rpm).

The developer carried on the developing roller 5 is thinned to form a layer by the doctor blade 12 made of stainless steel, and is conveyed to the developing region facing the photoconductive member 1, whereby executing development.

Now, a relevant part of the developing roller 5 is further described with reference to FIG. 3.

The developing roller 5 includes a hollow cylindrical developing sleeve 81 that carries developer, and a magnetic roller 82 installed in the developing sleeve 81 to magnetically attract the developer by a magnetic force.

The developing sleeve 81 is made of non-magnetic conductive material, such as aluminum, austenitic stainless steel, magnesium, etc.

The developing sleeve can have a smooth surface, but is preferably subjected to a roughening process to have a rough surface as mentioned blow.

Specifically, one of a V or U letter groove extrusion process, a machine or laser processing making various concaved shapes, and an etching (edging) process can be used. Also used is a blasting process. Yet further used is a thermal spraying process of spraying metal or ceramic or the like. The magnetic roller 82 is freely rotatable in a direction as shown by an arrow J opposite to a conveyance direction P in that the developer is conveyed. Specifically, even number of the magnets 83 (e.g. ten) are arranged at the same intervals with their poles being opposite too the neighboring magnets to be attracted by each other.

The magnetic roller 82 and the developing sleeve 81 are selectively driven either in the same or opposite directions, but one of the directions is selected so that a number of times when the magnetic poles of the magnet 83 in the magnetic roller 82 pass through the developer carried on the surface of the developing sleeve 81 increases.

Due to the above-mentioned increase in the number of facing times of the developer in relation to the magnets of the magnetic roller 82, a phenomena that the developer puts forth ears when facing the magnetic poles and looses the same when separated from the magnetic pole increasingly repeated, so that charge performance of toner can be improved. Because, a friction contact chance between the toner and carrier increases.

The above-mentioned increasing in the facing times can be obtained by appropriately determining a rotational direction and a difference in velocity between the magnetic roller 82 and the developing sleeve 81. Specifically, when both members rotate in the same direction, the facing times is increased by creating a difference in velocity there between. Further, when both members rotate in the different direction at the same velocity, the facing times can be increased. A result of experiment of the above-mentioned facing times obtained by varying a rotational direction and a difference in velocity is described later in detail with reference to FIG. 6.

The above-mentioned magnets 83 can be made of conventional low cost ferrite. However, to downsize or speed up, rare earth magnet, such as strong samarium-cobalt magnet, neodymium magnet, etc., can be employed. The magnets 83 are held by a magnet holder 84 with adhesive, and can be protected by a thermal contraction tube or the like that covers an outer circumference thereof.

When the magnet holder is made of magnetic material, a magnetic force of the magnet 83 slightly increases. However, cost also increases. At the same time, since magnetic material mainly including iron generally has high specific gravity, an inertia moment increases when rotated at high velocity revolution, and accordingly a driving section causes a durability problem sometime. Thus, although the magnetic force of the magnets 83 slightly decreases, non-magnetic material having low specific gravity, such as aluminum, magnesium, etc., can be employed.

Further, as shown, a rotational center P' of the magnetic rollers 82 is deviated from a rotational center P of the developing sleeve 81 by a distance T.

A direction of the deviation of the rotational center P' in relation to that of P is determined so that a point where developer carried on a surface of the developing sleeve 81 is almost transferred onto a photoconductive member 1 is located on or in the vicinity of an extension line P-P' extending in the deviational direction. Such an eccentric amount corresponding to the distance T enables to suppress the carrier to move to the photoconductive member 1 in a developing region due to a magnetic force caused by the magnetic pole in the vicinity thereof. Owing to this, the developer moving to the photoconductive member 1 can contact the photoconductive member maintaining formation of its ears. At the same time, only toner is supplied to a latent image on the photoconductive member while preventing the carrier from moving thereto by the magnetic force from the magnetic pole in the vicinity thereof.

Further, one the opposite side of the magnetic roller 82 to the photoconductive member 1 in the deviation direction, the magnetic roller 82 is distanced most from the circumferential surface of the developing sleeve 81. Thus, a larger space U is created there than a space facing the photoconductive member 1. As a result, a magnetic force reaching the front surface of the developing sleeve can be suppressed there to be low. Accordingly, the developer carried on the surface of the developing roller 5 can be easily peeled off there.

Only with such an eccentric structure, the developer can be readily peeled off without an external mechanical force as discussed in the Japanese Patent Application No. 2009-136052 filed by the same applicant.

Now, an exemplary experiment of counting a number of times when magnetic poles pass through developer carried in a region of a developing sleeve in a high speed copier that employs the above-mentioned developing device on condition that 60 to 70 printings are consecutively made per minute is described with reference to FIGS. 6A and 6B.

FIG. 6A shows an experience when the developing sleeve 81 and the magnetic roller 82 rotate in an opposite direction to each other as in the system of FIG. 9, and the result of the experiment is shown in FIG. 6B. However, their rotational directions can be the same if their velocities are appropriately differentiated to increase a number of times when the magnetic poles pass through the developer.

As shown, an example 4 indicates a situation where they rotate oppositely, while an example 5 indicates a situation where they rotate in the same direction (with a velocity difference). As a comparative example (i.e., a conventional example) is conditioned that a magnetic roller is secured.

As shown in FIG. 6A, a magnetic roller secured to a conventional developing device includes five magnetic poles. To obtain a copier velocity capable of consecutively printing 60 to 70 sheets per minute, a developing sleeve needs to be rotated at 400 rpm. In such a situation, the magnetic poles only pass through a portion between supplying and collection (clockwise) conveyance paths five times and the toner scatters when the developer is replaced or used after being left over in high humidity environment.

In the developing device of the example 1, ten magnetic poles are used. When a magnetic roller is rotated at 600 rpm while the developing sleeve rotates at 300 rpm clockwise, almost the same image density is obtained as the conventional example. Specifically, the magnetic poles pass through developer carried on a range of the developing sleeve between the supplying and collection conveyance paths about fifteen times and toner does not scatter even when developer is used just after being replaced or used after being left over in high humidity environment.

In the developing device of the example 2, ten magnetic poles are used. When a magnetic roller is rotated at 1200 rpm, and the developing sleeve rotates 180 rpm, almost the same image density is obtained as the conventional example. Specifically, the magnetic poles pass through a portion between the supplying and collection (clockwise) conveyance paths about thirty times, and toner does not scatter even when the developer is replaced or used after being left over in high humidity environment.

Further, in the developing device of the example 3, ten magnetic poles are used. When a magnetic roller is rotated at 2000 rpm, almost the same image density is obtained as the conventional example even if the developing sleeve is secured. Specifically, the magnetic poles pass through the portion between the supplying and collection (clockwise) conveyance paths about fifty times, and toner does not scatters even when the developer is replace or used after being left over in high humidity environment. However, noise occurs as the magnetic roller rotates at high speed.

Further, it is understood from FIG. 6B that the facing time increases than in the conventional system shown in FIG. 6A even if they are rotated oppositely at the same rpm with each other. It is further known therefrom that the facing times can be increased in accordance with a velocity difference therebetween even when they rotate in the same direction.

Hence, since there exist plural appropriate rpm conditions, one of them can be preferably chosen. Further, an appropriate condition can be optionally chosen even when a copying speed or a developing sleeve diameter is different. Yet further, it is the same as to a rotational direction.

Further, as shown, a developer peel-off device 90 is arranged adjacent to a circumference surface of the developing sleeve 81 on the opposite side of the magnetic roller 82 in the eccentric direction, i.e., a position opposite to a facing side where the developing sleeve 81 faces the photoconductive member 1.

The developer peel-off device 90 peels off carrier and toner passing through the developing region of the photoconductive member 1 and remaining on the circumferential surface of the developing sleeve 81. Further, as mentioned above, the developer peel-off device 90 includes a peel-off roller 90A arranged adjacent to an opposite portion of the circumference surface of the developing sleeve 81 in the eccentric direction of the magnetic roller so as to convey the developer peeled off. The developer peel-off device 90 also includes a magnetic roller 90B having plural magnetic poles arranged in the peel-off roller 90A in the circumferential direction thereof.

Figure 3:
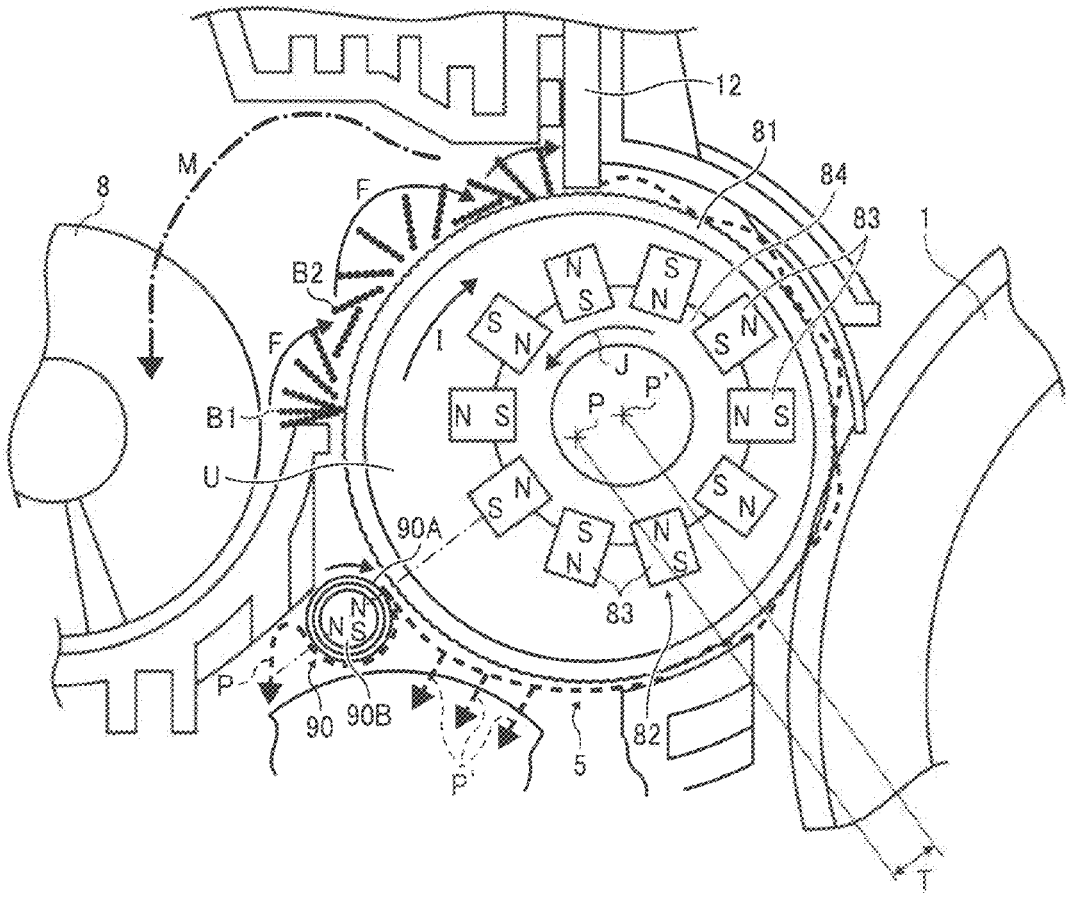
FIG. 3 illustrates an exemplary structure of the developing device installed in the process cartridge of FIG. 2.

The peel-off roller 90A is made of the same material having been subjected to the same surface processing as the developing sleeve 81, and is rotatable in a counter direction as shown by an arrow in FIG. 3 to that of the developing sleeve 81 as shown by that of I when facing thereto.

The peel off magnetic roller 90B includes an arrangement of magnetic poles capable of peeling off the carrier and toner remaining on the developing sleeve 81. In this embodiment, the magnetic poles align in an N, S, and N order while the N pole among them facing the developing sleeve 81.

Thus, the magnetic roller 82 and the magnetic poles 90B serve as first and second magnetic field generators, respectively.

The magnetic poles in the peel-off roller 90A employ, but not limited to, bond magnets produced by dispersing magnetic powder into polyimede resin (e.g. nylon), molding thereof, applying orientation thereto, and magnetizing thereof to downsize.

Owing to the above-mentioned magnetic arrangement of the first and second magnetic field generators 82 and 90B, the magnetic pole N of the peel off magnetic roller 90B faces a portion of the circumferential wall of the developing sleeve 81, where impact of the magnetic force from the magnetic roller 82 is weakest, i.e., the vicinity of a position farthest from the magnetic pole of the magnetic roller 82 almost on the eccentric line deviated by the eccentric amount T. Thus, the magnetic pole N of the peel off magnetic roller 90B can readily draw and peel off the developer from the developing sleeve 81.

Thus, the developer peel-off device 90 peels off carrier in the developer remaining on the developing sleeve 81 using a magnetic force generated by the magnetic pole of the peel off magnetic roller 90B. Specifically, when the toner in the developer is consumed, an electrostatic balance therebetween is lost (due to a counter charge) and as a result the carrier remains on the developing sleeve 81. To ease a difficulty in peeling off the carrier by using a centrifugal force caused by rotation of the developing sleeve 81 or own gravity, the developer peel-off device 90 forcibly peels off the carrier.

Further, the toner is sometimes repulsively attracted to the developing sleeve 81 by a surface potential on the photoconductive member and/or an electric field caused by a developing bias and remains thereon. Similar to the carrier, such toner cannot be peeled off by a centrifugal force caused by rotation of the developing sleeve 81 or its own gravity.

To peel off the toner attracted and remaining on the developing sleeve 81 owing to such a charge performance thereof, bias control is executed to move the toner from the developing sleeve 81 to the developer peel-off device 90 in addition to the above-mentioned developer peel-off device 90.

To execute bias control, a high voltage power supply, not shown, applies a developing bias, such as −500V, etc., to the developing sleeve 81 when a reverse developing system is employed using negative charge toner. Further, a high voltage power supply, not shown, applies a peel off bias having a relatively positive polarity, such as −300V, etc., to the side of the peel-off roller 90A of the developer peel-off device 90 in the same situation.

Now, transportation of toner with the above-mentioned structure is described with reference to FIG. 3.

Developer supplied to the developing roller 5 by the supplying screw 8 is attracted by a magnetic force of the magnetic roller 82 onto the developing sleeve 81 being aligned along the magnetic force line. Specifically, magnet ears are formed above the magnet 83 as shown by the reference B1. The magnet ears become upside down between (neighboring) magnets 83 as shown by the reference B2.

When the rotational direction (J) of the magnetic roller 82 is opposite to a rotational direction I of the developing sleeve 81, the magnetic ears rotate on its axis like in a flip-flop state, and proceeds to a direction shown by arrow F opposite to the direction J. However, the developing sleeve 81 can supplementary be rotated at a relatively low speed in the direction as shown by arrow I.

The height of the magnetic ears of the developer is determined by the development doctor 12 to a prescribed constant level. Surplus developer is returned to the supplying screw 8 along a stream as shown by arrow M, and is supplied again to the developing roller 5 being conveyed in a screw shaft direction.

As the developer passing through the development doctor 12 continuously rotates on its axis and moves ahead, an attraction force of them directed to the developer sleeve 81 gradually increases owing to the eccentricity of the magnetic roller 82. Thus, the carrier is prevented from moving to the photoconductive drum 1. Since the higher the rotation speed of the magnetic roller 82, the more actively the developer stirred at a facing section facing the photoconductive drum 1, the toner can be effectively transferred in accordance with a latent image.

As the developer further continuously rotates on its axis and moves ahead, an attraction force of them directed to the developer sleeve 81 gradually decreases owing to the eccentricity of the magnetic roller 82, and separates from the developing sleeve 81 by its own gravity on the supplying conveyance path 7. However, owing to the attraction force slightly remaining on the developing sleeve 81, some developer remains thereon.

When the remaining developer faces the peel-off roller 90A provided in the developer peel-off device 90, it moves to the peel-off roller 90A owing to a magnetic attraction force generated by the magnetic pole of the peel off magnetic roller 90B. The remaining developer carried on the surface of the peel-off roller 90A drops as shown by an arrow P by a repulsing force generated where the magnets of N poles neighbor each other. The developing sleeve 81 completes preparation for the next developer conveyance when the developer has thus been peeled off. A reference P' indicates movement of toner and carrier peeled off due to self gravity from a surface where affection of a magnetic force becomes weak due to eccentricity of the magnetic roller 82.

The carrier on the developing sleeve 81 is completely peeled off by a magnetic attraction caused by a magnetic pole arranged in the peel off magnetic roller 90B therefrom. However, the toner remains on the developing sleeve 81 due to having negative charge because of the reverse developing system in this embodiment. Thus, the toner is peeled off by the below described manner.

Since the magnetic pole N of the peel off magnetic roller 90B faces the developing sleeve 81, a magnetic brush puts force ear at a portion facing thereto. Since the developing sleeve 81 and the peel-off roller 90B move in opposite direction each other at the facing position, the magnetic brush where the putting forth ears actively slides and conflicts the developing sleeve 81. Thus, since the toner remaining on the developing sleeve 81 becomes readily charged by a friction of the magnetic brush on the peel-off roller 90A, it is attracted to the carrier. As a result, the toner remaining on the developing sleeve 81 is peeled off from the developing sleeve 81 while preventing it from being attracted to the surface of the peel-off roller 90A.

Further, the toner electro-statically attracted to the developing sleeve 81 electro-statically moves to the peel-off roller 90A due to a potential difference caused by the bias control between the developing sleeve 81 and the peel-off roller 90B. Accordingly, even the charged toner remaining on the developing sleeve 81 can also be peeled off toward the peel-off roller 90A.

With the structure of FIG. 3, the applicants confirmed thru their experiment that a ghost does not appear, which is generally caused by electrostatic attraction of toner and carrier onto a developing sleeve 81 and a peel-off roller 90A, based on below described mechanical conditions on a developing roller 5 and members 90A and 90B constituting the developer peel-off device 90.

Developing Roller 5:

Diameter of developing sleeve 81: 25 mm, Diameter of magnetic roller 83: 17.6 mm, Material of magnet: Rare earth bond magnet, Density of magnetic flux of magnetic roller 83 on eccentric side: 150 mT, and Density of magnetic flux of magnetic roller 83 on side opposite to eccentric side: 3 mT.

Peel-Off Roller 90A:

Diameter of peel off sleeve 90A: 10 mm, Diameter of peel off magnetic roller 90B: 8 mm, Material of magnet: Ferrite bond magnet, Density of magnetic flux of peel off magnetic roller 90B: 100 mT, Line velocity of peel off sleeve 90A: same to twice developing sleeve 81, and Gap up to developing roller 5: 0.2 to 2 mm.

Figure 4:
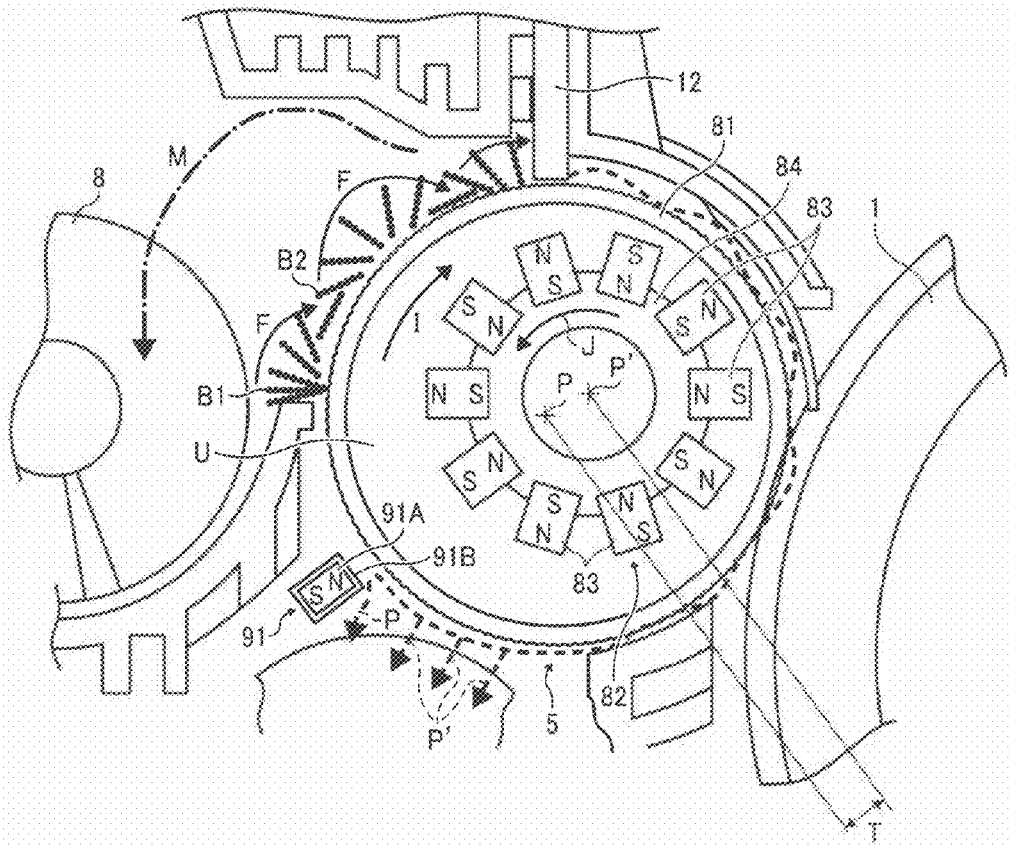
FIG. 4 illustrates an exemplary principle part of a modification of the developing device of FIG. 3.

Now, a modification of the structure of FIG. 3 is described with reference to FIG. 4. As shown, the developer peel-off device 91 includes a casing 90B and a magnet 91A secured thereto.

Since a rotation mechanism can be omitted, a peel off mechanism can be obtained at low cost.

Figure 5:
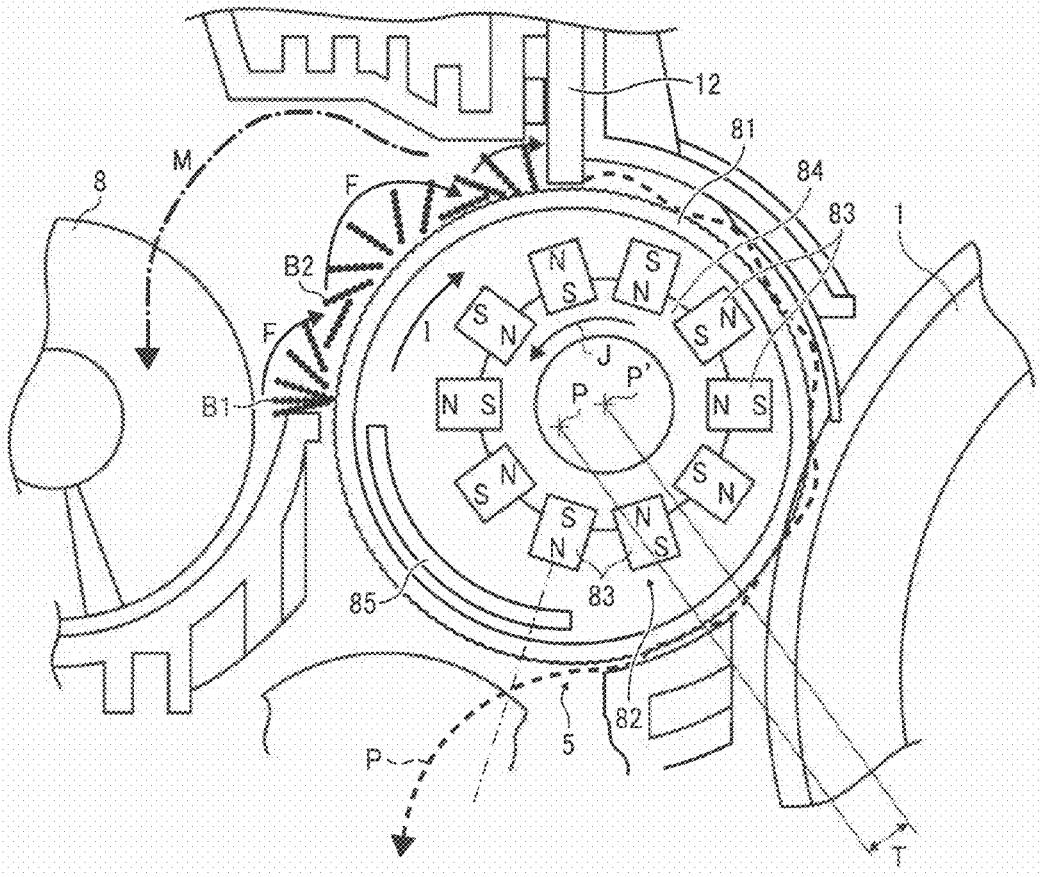
FIG. 5 illustrates an exemplary structure of the developing device, an operation of which is compared with that of the developing device of FIG. 2.

Hence, by deviating the magnetic roller 82 in the developing sleeve 81 and decreasing the impact of the magnetic force on the surface opposite to that facing the photoconductive member when the above-mentioned developer peel-off device is used, the toner and carrier remaining on the developing sleeve can drop by its own gravity or is separated by a centrifugal force from the developing sleeve. In addition, by providing a magnetic shield plate 85 at a section where a magnetic force slightly affects as shown in FIG. 5, a peel off performance can be improved.

Since the reverse developing system is employed using negatively charged toner, a high voltage power supply, not shown, applies a developing bias of negative polarity, such as −500V, etc., to the developing sleeve 81. Further, a high voltage power supply, not shown, applies a peel off bias of relatively positive polarity, such as −300V, etc., to the peel-off roller 90A. Thus, a potential difference between them is 200V.

Since the toner and carrier can be forcibly peeled off at low cost with the structure of the present embodiment, a ghost generally caused by not peeled off toner and carrier can be highly likely does not appear.

ADVANTAGE

According to the present embodiment, since the magnet generation device provided in the developer carrier is deviated toward the image bearer, and the developer peel-off device is arranged in the vicinity of the farthest position on the developer carrier from the image bearer where affection of the magnetic force is minimum, the affection of the magnetic force from the magnetic force generation device is suppressed and the carrier attracted to the developer carrier after when toner is consumed by passing through the developing region, as well as the toner not used there and continuously electrostatically attracted thereto can be peeled off.

Because, a developing system includes a first developer carrier to carry and supply two-component developer including toner and carrier to a latent image formed on an image bearer. A first magnetic field generator having plural first magnetic poles is rotatably installed in the first developer carrier and causes the two-component developer to put forth ears and conveys the two-component developer on the developer carrier. A cross sectional center of the first magnetic field generator is deviated from that of the first developer carrier toward the image bearer by a prescribed length. A developer peel-off device including a second magnetic field generator is provided in the vicinity of the surface of the first developer carrier to peel off the developer not supplied to the image bearer and remaining on the surface of the first developer carrier.

Further because, the second magnetic field generator includes a second magnetic filed creating member having plural second magnetic poles secured to the developing system, and a rotatable developer conveyance member arranged overlying the plural second magnetic poles. Yet further because, the plural two second magnetic poles have a prescribed arrangement capable of creating a repulsive magnetic field removing the developer attracted to the rotatable developer conveyance member of the second magnetic field generator therefrom. Yet further because, one of the plural second magnetic poles faces one of the plural first magnetic poles arranged farthest among the plural first magnetic poles from an inner circumferential surface of the first developer carrier (owing to the eccentricity of the first magnetic field generator toward the developer carrier).

Yet further because, a bias controller is provided to apply a prescribed bias between the first developer carrier and the developer peel-off device. The prescribed bias causes the toner to move from the first developer carrier to the developer peel-off device. Further because, the bias controller creates a prescribed voltage difference capable of moving the toner from the first developer carrier to the developer peel-off device.

Yet further because, the rotatable developer conveyance section moves in an opposite direction to the developer carrier at a gap therebetween. Yet further because, an image forming apparatus includes the developing system. Finally because, a process cartridge includes an image bearer top bear an image, the developing system to develop the image, and a holder to hold the developing system and the image bearer in a block.

Numerous additional modifications and variations of the present invention are possible in latent image of the above teachings. It is therefore to be understood that within the scope of the appended claims, the present invention may be practiced otherwise that as specifically described herein.

What is claimed is:

1. A developing system comprising:

a first developer carrier configured to carry and supply two-component developer to a latent image formed on an image bearer, said two-component developer including toner and carrier;

a first magnetic field generator including at least two first magnetic poles, said first magnetic field generator rotatably installed in the first developer carrier and configured to cause the two-component developer to put forth ears and convey the two-component developer on the first developer carrier, a cross sectional center of said first magnetic field generator being deviated toward the image bearer from that of the first developer carrier by a prescribed length; and a developer peel off device including a second magnetic field generator configured to peel off two-component developer not supplied to the image bearer and remaining on the surface of the developer carrier, said developer peel off device being arranged in the vicinity of the surface of the first developer carrier.

2. The developing system as claimed in claim 1, wherein said developer peel off device further includes a rotatable second developer carrier comprising a rotatable developer conveyance member overlying the second magnetic field generator and configured to carry and convey the two-component developer peeled off from the first developer carrier, and wherein said second magnetic field generator includes at least two second magnetic poles secured to the developing system.

3. The developing system as claimed in claim 2, wherein said rotatable developer conveyance member moves in an opposite direction to the developer carrier at a gap therebetween.

4. The developing system as claimed in claim 2, wherein said at least two second magnetic poles have a prescribed arrangement creating a repulsive magnetic field removing the developer attracted to the rotatable developer conveyance member of the second magnetic field generator therefrom.

5. The developing system as claimed in claim 1, wherein one of the at least two second magnetic poles faces one of the at least two first magnetic poles arranged farthest among the at least two first magnetic poles from an inner circumferential surface of the first developer carrier, owing to the eccentricity of the first magnetic field generator toward the developer carrier.

6. The developing system as claimed in claim 1, further comprising a bias controller configured to apply a prescribed bias between the first developer carrier and the developer peel off device, said prescribed bias causing the toner to move from the first developer carrier to the developer peel off device.

7. The developing system as claimed in claim 6, wherein said bias controller creates a prescribed voltage difference capable of moving the toner from the first developer carrier to the developer peel off device.

8. An image forming apparatus comprising;

a casing; and the developing system as claimed in any one of claims 1 to 7, wherein said developing system is installed in the casing.

9. A process cartridge comprising:

the developing system as claimed in claim 1;

the image bearer as claimed in claim 1; and a holder configured to house the developing system and the image bearer.

* * * * *